US008439119B2

(12) United States Patent
Sheth et al.

(10) Patent No.: US 8,439,119 B2
(45) Date of Patent: May 14, 2013

(54) LATCHING MECHANISM FOR CHANGING PUMP SIZE

(75) Inventors: Ketankumar K. Sheth, Tulsa, OK (US); Steven K. Tetzlaff, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 306 days.

(21) Appl. No.: 12/852,343

(22) Filed: Aug. 6, 2010

(65) Prior Publication Data

US 2011/0042101 A1 Feb. 24, 2011

Related U.S. Application Data

(60) Provisional application No. 61/235,611, filed on Aug. 20, 2009.

(51) Int. Cl.
*E21B 23/00* (2006.01)

(52) U.S. Cl.
USPC ..... 166/377; 166/105; 166/242.6; 417/319

(58) Field of Classification Search ..... 166/105, 166/377, 242.6; 417/242, 359, 360, 319, 417/423.6
See application file for complete search history.

(56) References Cited

U.S. PATENT DOCUMENTS

| | | | | |
|---|---|---|---|---|
| 2,083,714 | A * | 6/1937 | Keeler | 166/109 |
| 4,898,244 | A | 2/1990 | Schneider et al. | |
| 5,988,992 | A * | 11/1999 | Tetzlaff et al. | 417/360 |
| 2004/0103944 | A1 | 6/2004 | Shaw | |
| 2007/0274849 | A1 | 11/2007 | Martinez | |
| 2009/0159262 | A1 * | 6/2009 | Gay et al. | 166/105 |

FOREIGN PATENT DOCUMENTS

WO 9400668 A1 1/1994

* cited by examiner

*Primary Examiner* — David Andrews
*Assistant Examiner* — Richard Alker
(74) *Attorney, Agent, or Firm* — Bracewell & Giuliani LLP

(57) ABSTRACT

A latching mechanism for selectively disengaging an upper pump from a motor in an ESP. The latching mechanism comprises barbs formed on an upper end of an upper shaft that are engaged by a tool to lift the upper shaft until a lower end of the upper shaft disengages from an upper end of a motor shaft. When the upper pump is disengaged from the motor shaft, only a lower pump is driven by the motor and flow of well fluid is circulated past the disengaged upper pump via a bypass line. The upper pump shaft may reengage the motor shaft if additional lift is required.

19 Claims, 4 Drawing Sheets

LATCHING MECHANISM FOR CHANGING PUMP SIZE

CROSS-REFERENCE TO RELATED APPLICATION

This application claims priority to provisional application 61/235,611, filed Aug. 20, 2009.

FIELD OF THE INVENTION

This invention relates in general to the operation of electrical submersible pumps (ESPs), including Electrical Submersible Progressive Cavity Pumps (ESPCPs) and in particular to changing the pump size of an ESP or ESPCP in a well while ESP or ESPCP system is installed.

BACKGROUND OF THE INVENTION

Electrical submersible pumps ("ESP") are used to pump wellbore fluids from the depths of the earth to the surface. A typical ESP has a motor, a seal section, and a pump. The motor rotates a shaft inside the seal section. The seal section shaft is connected to the pump. The ESP pump is typically an impeller pump having multiple stages. Each pump stage has an impeller and a diffuser through which wellbore fluid travel. In operation, wellbore fluids enter the first impeller and are accelerated by centrifugal force out of the impeller into the adjacent diffuser. The diffuser then reduces the velocity of the wellbore fluid, converts the high velocity to pressure, and directs the fluid into the next impeller. The pressure of the wellbore fluid is increased with each successive stage as described above, until the fluid is discharged from the pump into tubing that carries the fluid to the surface.

A central pump shaft is connected to the seal section shaft. As the motor rotates, it ultimately causes the central pump shaft to rotate. The central pump shaft passes through each impeller. Keys or splines on the shaft engage corresponding slots on each impeller so that the impellers rotate with the shaft. Spacers are frequently required between the impellers so that the impellers are properly spaced to engage the diffusers.

An electrical submersible progressive cavity pump ("ESPCP") having a single stator and a rotor may also be used. A typical ESPCP has a motor, a seal section, and a pump. An optional gearbox may also be included. A PCP is a positive displacement pump in which the rotor and the stator have cavities that are filled with fluid. As the rotor is rotated by the motor, fluid is moved upward. For discussion purposes only, ESP is used throughout with the understanding that either an ESP or ESPCP can be used.

Multiple ESP pumps may be connected in series and used in a single well. The ESP pumps are typically driven by a single motor with the shaft running through each of the ESP's. During operation, multiple ESP pumps, or tandem pumps, arranged in this manner provide additional lift that may be necessary to lift the wellbore fluids to the surface.

In wells where tandem pumps are deployed, there may be times during the life of a well where a reduced number of stages or a single ESP pump may be required to lift the fluids. Running the additional ESP pump or increased number of stages is inefficient and expensive. However, to disengage the ESP pumps from the shaft, the ESP string typically requires the ESP system to be pulled out of the well. This is an expensive proposition because production must be stopped during this procedure and subsea replacement can cost millions of dollars.

It would be advantageous to selectively engage or disengage an ESP pump from a drive shaft without pulling the ESP assembly from the well.

SUMMARY OF THE INVENTION

In an embodiment of the present technique, a latching mechanism including a pump shaft adapted to latchingly engage a tool for disengaging the pump shaft of the upper pump from engagement with a second shaft of a lower pump, is shown. The lower pump shaft transfers torque produced by a motor to drive a pump shaft in the upper pump when they are engaged through coupling. This embodiment further includes a sleeve keyed to the pump shaft that is in sliding engagement with a stationary bushing connected to a bearing housing that is located within the pump. A spring retainer may be connected to the stationary bushing to allow for receiving and retaining of a protrusion keyed to the pump shaft. This allows the pump shaft to be maintained in a disengaged position, effectively changing the size and capacity of the ESP assembly. The invention described herein may also be used with progressive cavity pumps to change their size and capacity.

The latching mechanism may also include an adapter located at the upper end of the of the pump that has a cylindrical body. The adapter may have a bypass port and a sleeve that is in sliding engagement with the adapter. The sleeve slides between a closed position and open position to control well fluid flowing through the bypass port. A bypass line may also be used to communicate well fluid from a discharge of a pump driven by the motor to the bypass port of the adapter to thereby bypass the disengaged pump. Thus, the latching mechanism described above advantageously changes the pump size to prevent wasteful operation and without the need for pulling the ESP string to disengage the upper pump.

DETAILED DESCRIPTION OF THE INVENTION

Figure 1:
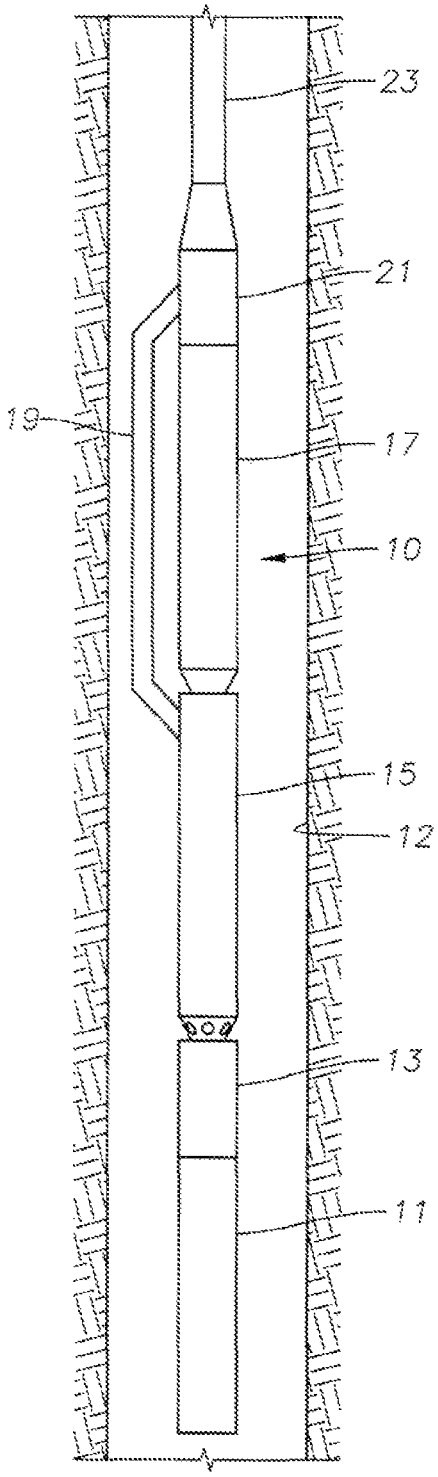
FIG. 1 shows an ESP with multiple pumps and suspended from production tubing, in accordance with an embodiment of the invention.

In FIG. 1, an embodiment of a well pump assembly 10 is shown in a sideview suspended in a well 12. The pump assembly 10 of FIG. 1 include a motor 11 at its base that is connected on its upper end to a seal section 13. A lower pump 15, is attached to the seal section 13 upper end that in turn connects to an upper pump 17. Seal section 13 equalizes the pressure of lubricant in the interior of motor 11 with hydrostatic well fluid pressure. Motor 11 rotates a shaft (not shown)

coupled to a shaft of lower pump 15; lower pump 15 shaft is coupled to a shaft of upper pump 17. During normal operation, motor 11 drives both upper and lower pump 15, 17 shafts, and fluid discharged by lower pump 15 flows into the intake of upper pump 17. Pumps 15, 17 provide the lift required to overcome the initial, high viscosity of the well fluid. In addition, because the head produced by a pump varies with the square of the speed of the motor 11, running pumps 15, 17 together compensates for the initially low speed of the motor 11 at startup. However, as well fluid flow increases, fluid temperature also increases to decrease fluid viscosity. Further, lift from one pump is sufficient once higher motor speeds are achieved. Operating the two pumps 15, 17 can thus be wasteful and inefficient once sufficient lift can be generated by one pump.

In an embodiment of this invention, the upper pump 17 can be selectively disconnected from the lower pump 15 driven by motor 11 without pulling the pump assembly out of the well. Production would be stopped momentarily to disengage the shaft 29 (FIGS. 2 and 3) of the upper pump 17. After disconnection, the fluid from lower pump 15 could flow though upper pump 17, and into production tubing 27 for flowing to the surface. The internal parts, such as the impeller, of the disconnected upper pump 17 would introduce a pressure drop that the connected lower pump 15 would have to overcome. Further, the fluid flowing through upper pump 17 rotates its impeller.

The embodiment of FIG. 1 also includes a bypass line 19 connected on one end to a discharge of lower pump 15. An adapter 21 (which will be described in more detail below) is shown disposed between the upper pump 17 and production tubing 23. The end of the bypass line opposite the lower pump 15 connects to the adapter 21.

Figure 2:
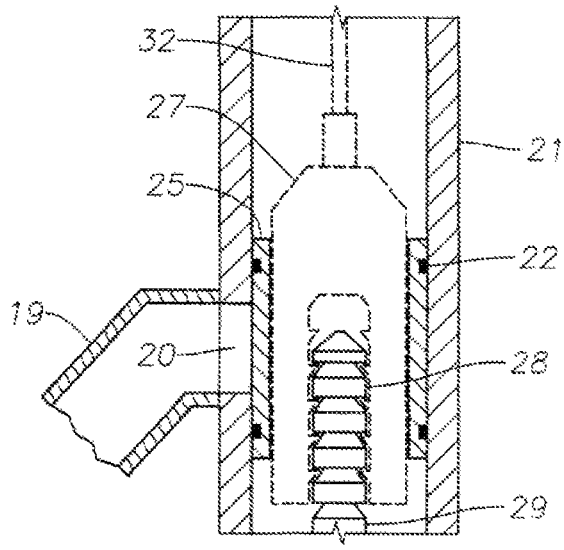
FIG. 2 is a sectional view of an adapter for disconnecting the shaft of a pump, in accordance with an embodiment of the invention.
Figure 3:
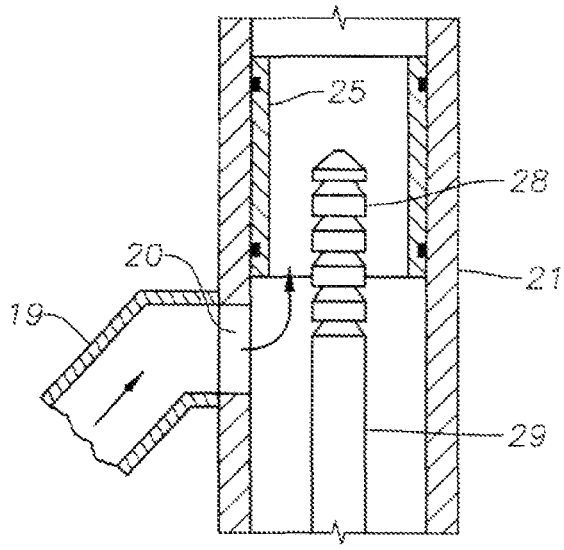
FIG. 3 is a sectional view of an adapter for disconnecting the shaft of a pump with a sleeve in a position to allow flow from a bypass, in accordance with an embodiment of the invention.

Alternatively, as shown in FIG. 1, fluid flow can bypass the disconnected upper pump 17. When upper pump 17 is disconnected from being driven by the motor shaft, the flow from lower pump 15 can flow through a port 50 (FIG. 4C) to the bypass 19 and into adapter 21. The bypass line 19 registers with a port 20 at its upper end that is formed through the annular adapter wall. An embodiment shown in FIGS. 2 and 3 illustrate one way fluid can selectively be directed through the bypass 19 and adapter 21 and into the production tubing 23 for flowing to the surface. An annular sliding sleeve 25 as shown can be coaxially located within adapter 21. When upper pump 17 driven by the motor shaft, the sliding sleeve 25 covers the port 20, thereby blocking flow exiting the bypass 19. Seals 22 can prevent fluid flow between the sleeve 25 and adapter 21. To shift sleeve 25 away from the bore 20 as shown in FIG. 3, a tool 27 shown in dashed outline, such as an overshot tool, can be lowered through tubing 23 (FIG. 1) on wireline 32. The tool 27 can be conventional, with outward facing, spring loaded lugs that can engage, for example, a shoulder (not shown) on the inner surface of the sleeve 25.

Figure 4A:
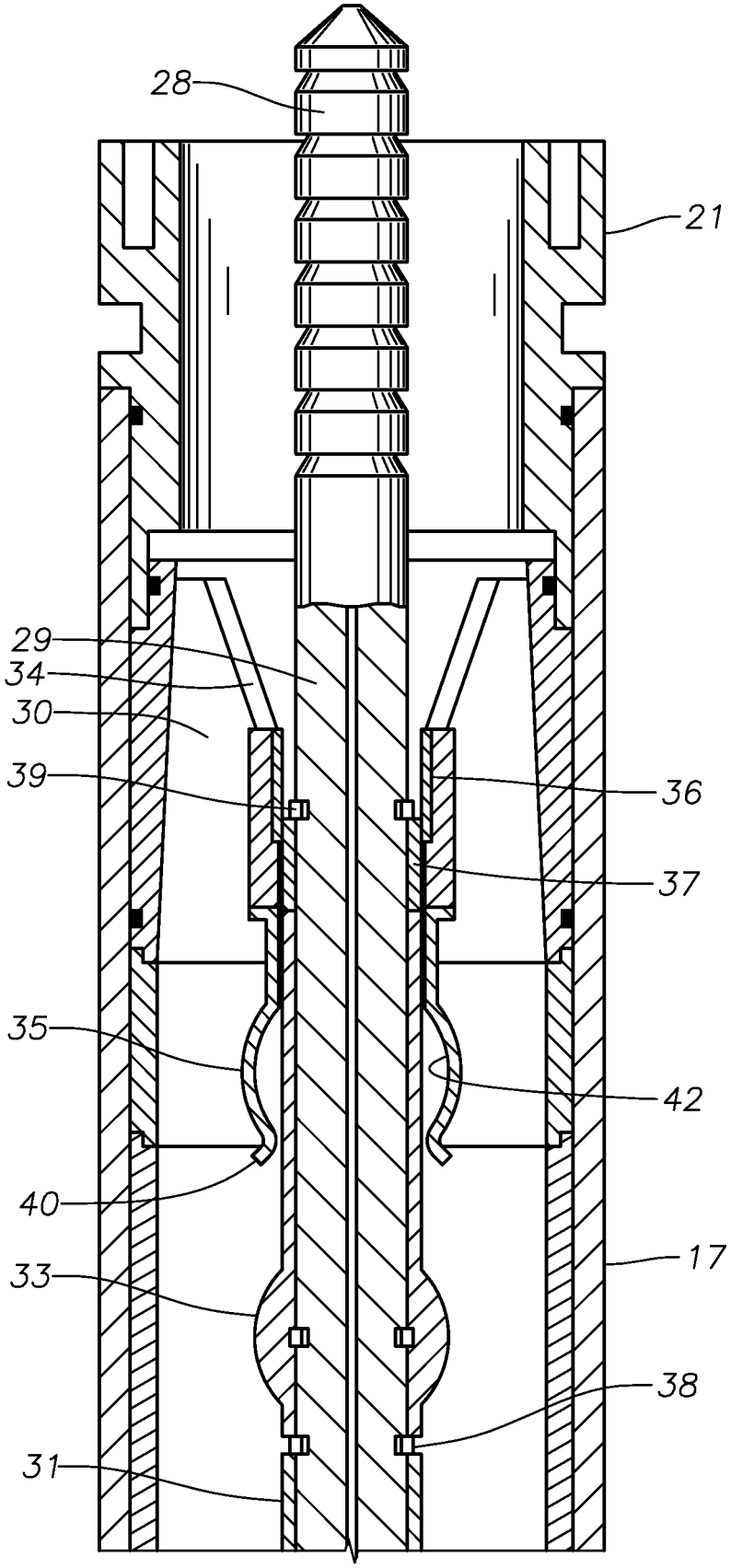
FIG. 4A is an enlarged sectional view of an upper pump assembly, in accordance with an embodiment of the invention.
Figure 4B:
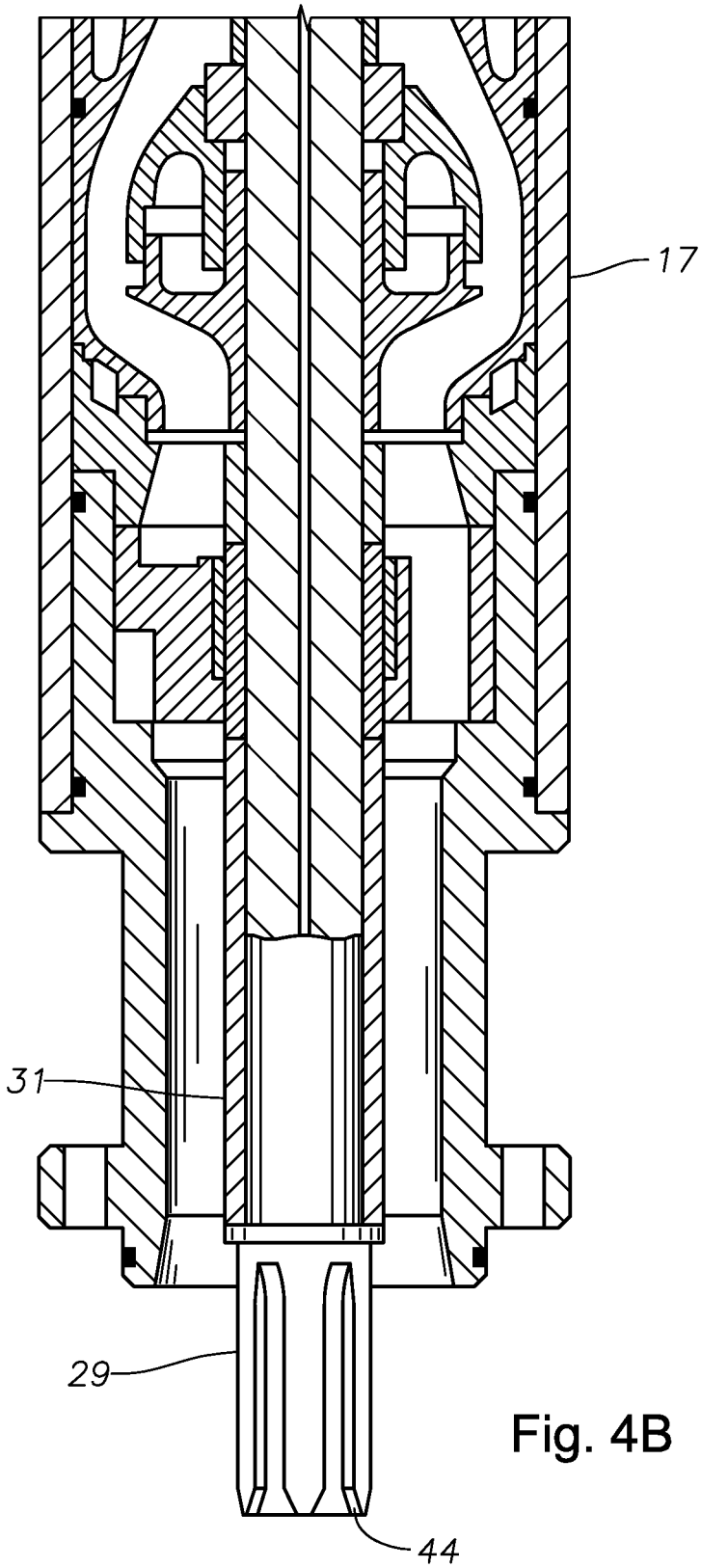
FIG. 4B is an enlarged sectional view of a lower end of an upper pump assembly in accordance with an embodiment of the invention.

FIGS. 4A and 4B, illustrate one embodiment for disengaging the shaft 29 of the upper pump 17 from the motor 11. Although the adapter 21 is shown without the sliding sleeve 25 described above, the sleeve 25 can also be used as previously described. An annular bearing housing 30 located inside the upper pump 17 circumscribes and radially supports the shaft 29 at its upper end. A sleeve 31, which supports a ball stop 33, is coaxially mounted around and keyed to the shaft 29. The ball stop 33 can be a ball with a passage drilled through it and a key formed within the passage that can engage a slot on the shaft 29. Alternatively, a slot could be formed within the passage in the ball stop 33 that could receive a key or rib formed on the shaft 29. A conventional split ring assembly (not shown) can be used to lock the ball stop 33 to a location on the shaft 29 or alternatively, retaining rings 38, 39 can be keyed to the shaft 29 on either side of the ball stop 33 to lock it into place. The ball stop 33 snaps into engagement with a spring retainer or grapple 35 to hold shaft 29 in the upper disengaged position after wireline tool 27 is retrieved. In this embodiment, the grapple 35 is supported from the bearing housing 30. As shown, the grapple 35 includes cantilevered spring members 34 mounted to the annular bearing housing 30. An annular bushing 36 connects to one end of the cantilevered spring members 34 and is disposed around the shaft 29. The spring members 34 have a free end 40 depending downward towards the ball stop 33 and a mid-section 42 profiled similar to the ball stop 33 outer periphery.

Figure 4C:
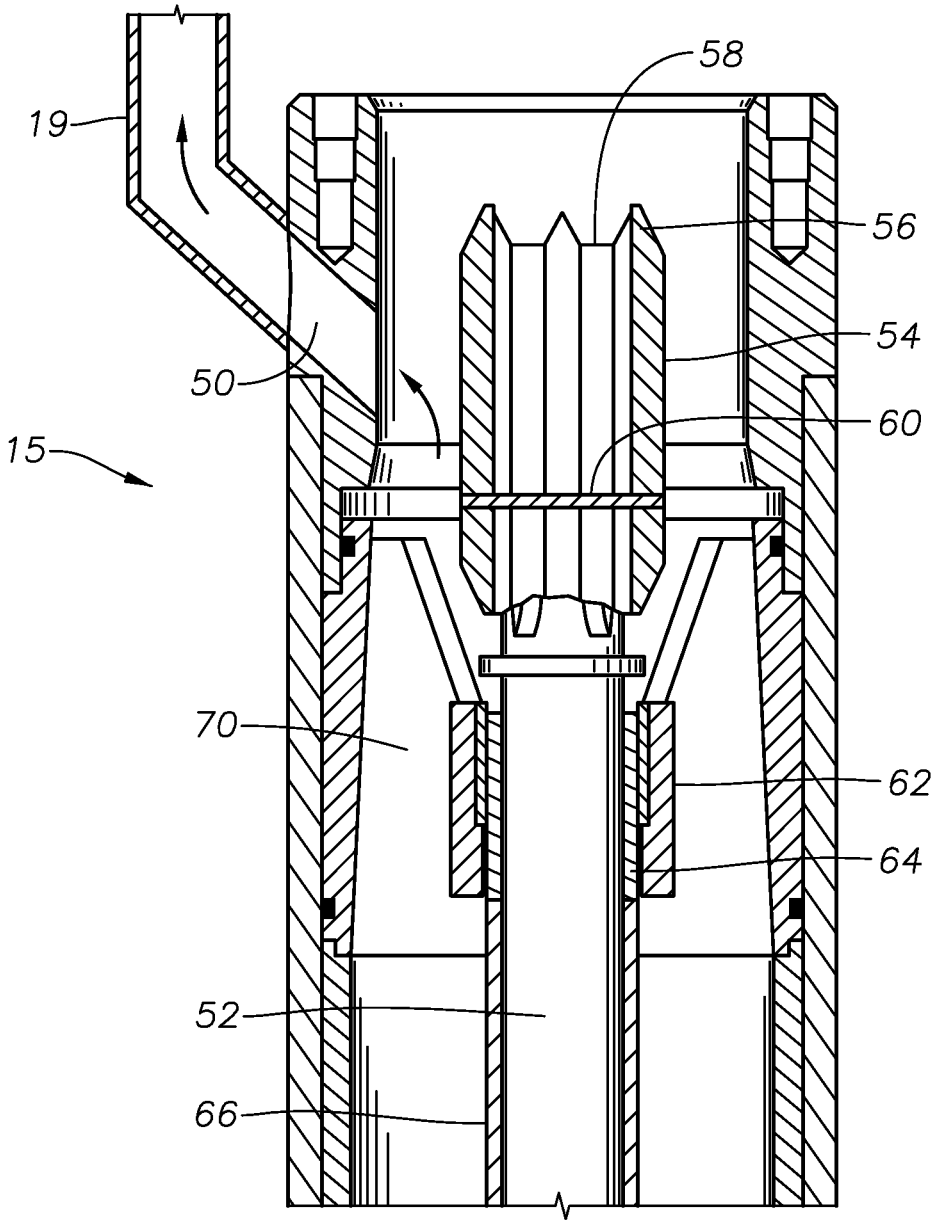
FIG. 4C is an enlarged sectional view of a top end of a lower pump assembly in accordance with an embodiment of the invention.

During the disengagement operation, the shaft 29 of the upper pump 17 can be disengaged at the same time the tool 27 shifts the sliding sleeve 25 upward to open the bypass bore 20 (FIG. 3). The tool 27 can latch onto the fishing neck 28 of shaft 29 (FIG. 2). The tool 27 can have inward facing, spring loaded lugs that can latch onto the fishing neck 28. Although the fishing neck 28 is shown with multiple recesses, a single recess can allow engagement with the tool 27. Once the tool 27 latches onto the shaft 29 of upper pump 17, it is pulled upward sufficiently to cause splines 44 (FIG. 4B) at the lower end of the shaft 29 to disengage from a coupling 54 (FIG. 4C) secured to a top end of a lower shaft 52 with a pin 60 and running through an axis of lower pump 15 as shown in FIGS. 4B and 4C. This essentially disconnects the upper pump 17 from the lower pump 15. An annular bushing 62 is disposed around the lower shaft 52 which surrounds a bushing 64. The bushing 64 is keyed to the lower shaft 52 and is in contact with a sleeve 66 that may also be keyed to the shaft 52. As in the upper pump 17, the lower pump shaft 52 is radially supported at its top end to the annular bearing housing 70 of the lower pump 15.

As shaft 29 moves upward, it also moves sleeve 31, a bushing 37 keyed to the shaft 29, and retaining ring 39 also keyed to the shaft 29, upward relative to the grapple 35 and bushing 36. The shaft 29 is pulled upward until the ball stop 33 snaps into engagement with the grapple 35 to hold shaft 29 in the upper disengaged position. Bushing 36 on grapple 35 and bushing 37 keyed to the shaft 29 slidingly and coaxially engage when the ball stop 33 snaps into engagement with the grapple 35. A retaining ring 38 located below the ball stop 33 and keyed to the shaft supports the ball stop 33 and prevents it from moving if the shaft 29 is overpulled. As explained earlier, in this embodiment, the ball stop 33 can be locked into place on the shaft 29 by the retaining ring 38 located below the ball stop 33 and the retaining ring 39 located above bushing 37. In addition to locking the ball stop 33 in place, in this embodiment the retaining rings 38, 39 also function to hold the portion of the sleeve 31 and bushing 37 between the retaining rings, in place. To retrieve the tool 27, a shear pin (not shown) in the tool can be sheared to release from the fishing neck 28 barbs on the shaft 29. The shaft 29 can be reconnected to lower pump shaft 52 (FIG. 4C) and thus the motor by landing a weight bar on the upper end of the shaft 29. This disengages the ball stop 33 from the grapple 35, thus allowing the splines 44 (FIG. 4B) at the lower end of shaft 29 to reengage the splines 56 and recesses 58 (FIG. 4C) on the coupling 54 at the upper end of the lower pump shaft 52.

In an additional embodiment, shaft 29 and sliding sleeve 25 could be shifted upward by sending power to an electromechanical device permanently mounted to adapter 21. The electromechanical device would thus disconnect the shaft 29 and open the bypass port 19. The shaft 29 and sliding sleeve 25 could also be shifted upward by a hydraulically device permanently mounted to adapter 21.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A well pump assembly, comprising:

upper and lower pumps adapted to be suspended within a well, each of the pumps having a rotatable shaft enclosed within a housing, the shafts having mating ends that are coupled together by a splined coupling;

the shaft of the upper pump being upwardly movable relative to the housing of the upper pump and relative to the shaft of the lower pump from a coupled position to a de-coupled position;

an upper portion of a latch mounted in the housing of the upper pump;

a lower portion of the latch mounted to the shaft of the upper pump for upward movement therewith, the lower portion of the latch engaging the upper portion of the latch when the shaft of the upper pump is moved upwardly to the de-coupled position to retain the shall of the upper pump in the de-coupled position.

2. The assembly according to claim 1, further comprising:

a bypass conduit extending from a discharge of the lower pump alongside the upper pump to a discharge of the upper pump; and a closure member that blocks flow from the lower pump through the bypass conduit while the shafts are in the coupled position and opens flow through the bypass conduit while the shafts are in the de-coupled position.

3. The assembly according to claim 1, wherein the lower portion of the latch comprises:

a protrusion extending radially outward from the shaft of the upper pump relative to an axis of the shaft of the upper pump.

4. The assembly according to claim 1, wherein the upper portion of the latch comprises:

a spring retainer stationarily mounted in the housing of the upper pump and surrounding the shaft of the upper pump, the spring retainer having downwardly extending fingers that are resilient to engage the lower portion of the latch.

5. The assembly according to claim 1, further comprising:

a tool adapted to be lowered into the well by wireline, the tool having a latching mechanism to engage and lift the shaft of the upper pump to the de-coupled position.

6. The assembly according to claim 5, further comprising:

a lower discharge conduit between the lower pump and the upper pump;

an upper discharge conduit at an upper end of the upper pump;

a bypass conduit extending from a port in a sidewall of the upper discharge conduit alongside the upper pump to a port in a sidewall of the upper discharge conduit;

a sliding sleeve mounted within the upper discharge conduit, the sleeve having a lower position that blocks the port in the upper discharge conduit and an upper position that opens the port in the upper discharge conduit; and wherein the tool simultaneously moves the sliding sleeve to the open position while moving the shah of the upper pump to the de-coupled position.

7. The assembly according to claim 5, further comprising a fishing neck on an upper end of the shaft of the upper pump for engagement by the tool.

8. The assembly according to claim 1, further comprising:

a wireline tool adapted to be lowered into the well into engagement with an upper end of the shaft of the upper pump so that an upward pull on the wireline lifts the shaft of the upper pump to the de-coupled position; wherein the wireline tool is configured to be retrieved while the upper and lower portions of the latch retain the shaft of the upper pump in the de-coupled position; and wherein the wireline tool is configured to be lowered again into the well to deliver an impact to the shaft of the upper pump, moving the shall of the upper pump back into the coupled position.

9. A well pump assembly, comprising:

upper and lower pumps adapted to be suspended within a well, each of the pumps having a rotatable shaft enclosed within a housing, the shafts having mating ends that are coupled together by a splined coupling;

the shaft of the upper pump being upwardly movable relative to the housing of the upper pump and relative to the shaft of the lower pump from a coupled position to a de-coupled position;

a grapple stationarily mounted in the housing of the upper pump; and a protrusion mounted to the shaft of the upper pump for upward movement therewith, the protrusion extending radially outward from the shaft, the protrusion being spaced below the grapple while the shaft of the upper pump is in the coupled position, the protrusion moving upward with the shaft of the upper pump and being grasped by the grapple when the shaft of the upper pump moves to the de-coupled position, thereby retaining the shaft of the upper pump in the de-coupled position.

10. A well having a pumping assembly, comprising:

a string of production tubing extending into the well;

upper and lower pumps suspended on the string of tubing, each of the pumps having a rotatable, shall enclosed within a housing, the shafts having mating ends that are coupled together by a splined coupling;

the shaft of the upper pump being upwardly movable relative to the housing of the upper pump and relative to the shaft of the lower pump from a coupled position to a de-coupled position;

a retainer in the upper pump that releasably holds the shaft of the upper pump in the de-coupled position; and a motor located below the lower pump and operably connected to the shaft of the lower pump for rotating the shafts while the shafts are in the coupled position, the motor rotating the shaft of the. lower pump while the shafts are in the de-coupled position.

11. The assembly according to claim 10, further comprising:

a bypass conduit extending from is discharge of the lower pump alongside the upper pump to a discharge of the upper pump; and a closure member that blocks flow from the lower pump through the bypass conduit while the shafts are in the coupled position and opens flow through the bypass conduit while the shafts are in the de-coupled position.

12. The assembly according to claim 10, further comprising:

a tool adapted to be lowered into the production tubing by wireline, the tool having a latching mechanism to engage and lift the shaft of the upper pump to the de-coupled position.

13. The assembly according to claim 12, further comprising:

a lower discharge conduit between the lower pump and the upper pump;

an upper discharge conduit at an upper end of the upper pump;

a bypass conduit extending from a port in a sidewall of the lower discharge conduit alongside, the upper pump to a port in a sidewall of the upper discharge conduit;

a sliding sleeve mounted within the upper discharge conduit, the sleeve haying a lower position that blocks the port in the upper discharge conduit and an upper position that opens the port in the upper discharge conduit; and wherein the too simultaneously moves the sliding sleeve to the open position while moving the shaft of the upper pump to the de-coupled position.

14. A method for disconnecting an upper well pump from a lower well pump of a submersible wed pump assembly, each of the well pumps having, a housing enclosing a rotatable shaft, the shafts being coupled together by a splined coupling, the pump assembly having a motor coupled to the shaft of the lower pump for rotating the shafts while coupled together, the method comprising:

(a) moving the shaft of the upper pump upward relative to the housing of the upper pump and relative to the shaft of the lower pump from a coupled position to a decoupled position;

(b) retaining the shaft of Me upper pump in the housing of the upper pump in the de-coupled position; then (c) operating the motor to rotate the shaft of the lower pump relative to the shaft of the upper pump.

15. The method of claim 14, further comprising:

connecting a bypass conduit from a discharge of the lower pump to a point above the upper pump;

closing the bypass conduit while the shafts are in the coupled position;

opening the bypass conduit while the shafts are in the do-coupled position; and step (c) comprises flowing well fluid from the lower pump through the bypass conduit.

16. The method of claim 14, wherein the pump assembly is suspended on a string of production tubing, and step (a) comprises:

lowering a tool on wireline through the tubing and engaging the shaft of the upper pump with the tool; then operating the tool to move the shaft of the upper pump upward.

17. The method of claim 16, wherein operating the tool to move the shaft. comprises pulling upward on the wireline.

18. The method of claim 14, wherein step (b) comprises:

mounting an upper portion of a latch in the housing of the upper pump;

mounting a lower portion of the latch to the shaft of the upper pump, the lower portion of the latch being spaced below the upper portion of the latch while the upper shaft is in the coupled position; and moving the lower portion of the latch upward with the shaft of the upper pump into releasable engagement with the upper portion of the latch while the upper shaft is being moved to the de-coupled position.

19. The method of claim 14, further comprising:

after step (c), moving the shaft of the upper pump downward from the de-coupled position to the coupled position.

* * * * *

UNITED STATES PATENT AND TRADEMARK OFFICE

CERTIFICATE OF CORRECTION

PATENT NO. : 8,439,119 B2
APPLICATION NO. : 12/852343
DATED : May 14, 2013
INVENTOR(S) : Sheth et al.

It is certified that error appears in the above-identified patent and that said Letters Patent is hereby corrected as shown below:

In the Claim

Claim 1, Column 5, line 32, delete "shall" and insert - -shaft- -
Claim 6, Column 6, line 4, delete "shah" and insert - -shaft- -
Claim 8, Column 6, line 20, delete "shall" and insert - -shaft- -
Claim 10, Column 6, line 45, delete "shall" and insert - -shaft- -
Claim 11, Column 6, line 61, delete "is" and insert - -a- -
Claim 13, Column 7, line 15, delete the comma (,) after "alongside"
Claim 13, Column 7, line 20, delete "too" and insert - -tool- - before "simultaneously"
Claim 14, Column 7, line 34, delete "Me" and insert - -the- - before "upper"
Claim 15, Column 8, line 9, delete "do-coupled" and insert - -de-coupled- -

Signed and Sealed this
Tenth Day of September, 2013

Teresa Stanek Rea
*Acting Director of the United States Patent and Trademark Office*